US009452303B2

(12) United States Patent
Van Gelder et al.

(10) Patent No.: US 9,452,303 B2
(45) Date of Patent: Sep. 27, 2016

(54) VALVE DEVICE AND METHOD FOR PREVENTING EXPLOSION PROPAGATION

(71) Applicant: Stuvex International NV, Kontich (BE)

(72) Inventors: Paul Alfons Leon Van Gelder, Onze-Lieve-Vrouw-Waver (BE); Peter Jozef Regina Maria Macken, Schilde (BE)

(73) Assignee: Sturvek International NV, Kontich (BE)

( * ) Notice: Subject to any disclaimer, the term of this patent is extended or adjusted under 35 U.S.C. 154(b) by 0 days.

(21) Appl. No.: 14/423,606

(22) PCT Filed: Aug. 26, 2013

(86) PCT No.: PCT/BE2013/000042

§ 371 (c)(1),
(2) Date: Feb. 24, 2015

(87) PCT Pub. No.: WO2014/032125

PCT Pub. Date: Mar. 6, 2014

(65) Prior Publication Data

US 2015/0238787 A1 Aug. 27, 2015

(30) Foreign Application Priority Data

Aug. 27, 2012 (BE) ..... 2012/0559
Oct. 29, 2012 (BE) ..... 2012/0742

(51) Int. Cl.

| | |
|---|---|
| ***A62C 2/00*** | (2006.01) |
| ***A62C 2/12*** | (2006.01) |
| ***A62C 3/04*** | (2006.01) |

(Continued)

(52) U.S. Cl.

CPC . *A62C 2/12* (2013.01); *A62C 3/00* (2013.01); *A62C 3/04* (2013.01); *A62C 31/22* (2013.01); *A62C 35/00* (2013.01); *A62C 37/36* (2013.01); *A62C 99/0009* (2013.01); *A62C 99/009* (2013.01); *E21F 5/00* (2013.01)

(58) Field of Classification Search

CPC .. A62C 99/009; A62C 99/0009; A62C 3/00; A62C 31/22; A62C 35/00; A62C 37/36; A62C 2/12; A62C 3/04; E21F 5/00

USPC ..... 169/26, 45, 46, 54, 61, 64, 66, 70

See application file for complete search history.

(56) References Cited

U.S. PATENT DOCUMENTS 2,352,378 A * 6/1944 Geertz ..... A62C 3/04 169/45
3,912,015 A * 10/1975 Garbee ..... A62C 3/00 169/26

(Continued)

FOREIGN PATENT DOCUMENTS

| | | | |
|---|---|---|---|
| DE | 19701678 | A1 | 7/1998 |
| EP | 0595729 | A1 | 5/1994 |
| WO | 8703210 | A1 | 6/1987 |

*Primary Examiner* — Steven J Ganey

(74) *Attorney, Agent, or Firm* — The Webb Law Firm

(57) ABSTRACT

A valve device includes a housing and a closing body for closing a passage in the housing in mechanical manner, wherein the closing body is movable between an open position and a closing position; a reservoir for a flame-extinguishing substance; and an injecting means configured to inject the flame-extinguishing substance into the passage in order to prevent explosion propagation resulting from a non-fully sealed closure by the closing body.

20 Claims, 4 Drawing Sheets

(51) Int. Cl.

| | |
|---|---|
| ***A62C 99/00*** | (2010.01) |
| ***A62C 31/22*** | (2006.01) |
| ***E21F 5/00*** | (2006.01) |
| ***A62C 37/36*** | (2006.01) |
| ***A62C 3/00*** | (2006.01) |
| ***A62C 35/00*** | (2006.01) |

(56) References Cited

U.S. PATENT DOCUMENTS 5,676,712 A * 10/1997 Anderson ..... A62C 4/02 169/54

6,112,823 A 9/2000 O'Leary

* cited by examiner

VALVE DEVICE AND METHOD FOR PREVENTING EXPLOSION PROPAGATION

CROSS-REFERENCE TO RELATED APPLICATIONS

This application is the United States national phase of International Application No. PCT/BE2013/000042 filed Aug. 26, 2013, and claims priority to Belgian Patent Application Nos. 2012/0559 and 2012/0742 filed Aug. 27, 2012 and Oct. 29, 2012, respectively, the disclosures of which are hereby incorporated in their entirety by reference.

BACKGROUND OF THE INVENTION

1. Field of the Invention

The present invention relates to a valve device and to a method for avoiding explosion propagation in conduits or for limiting the consequences of explosion propagation in conduits.

2. Description of Related Art

In existing systems with conduits connected to volumes in which there is explosion hazard, either mechanical shut-off valves or chemical shut-off valves are used, or a mechanical valve is provided at a distance downstream of a chemical barrier. Chemical devices have the drawback of requiring a relatively large amount of extinguishing agent, particularly for conduits with a large diameter, and that the extinguishing agent is exhausted relatively quickly. Mechanical devices have the drawback that they are either not completely sealed as a result of for instance seals which do not fit perfectly between the closing body and the passage and/or an inadequate locking of the closing body in the housing, or that they are highly complex and expensive.

WO 87/03210 describes a device for eliminating fire risks resulting from the presence of glowing particles in a pipeline. An extinguishing agent is injected for this purpose via a line which debouches in the vicinity of the valve body. In such systems the glowing particles move at a process speed of typically 21 m/s. Such devices operate preventively and are intended for the purpose of avoiding explosion hazard, i.e. to ensure that no explosions occur. Such a device is not intended and not suitable for the purpose of preventing explosion propagation in conduits, since an explosion advances at a speed which is more than 10 times greater than that of glowing particles. The explosion propagation speed is typically around 300 m/s. The present invention relates to taking so-called curative, post-explosion measures which must ensure that a pressure wave front cannot advance in the conduit.

Embodiments of the present invention have the object of obviating these drawbacks by providing a valve device and method which are simple but nevertheless guarantee that explosion propagation is prevented in reliable manner.

SUMMARY OF THE INVENTION

For this purpose an embodiment of a valve device according to the invention comprises:

- a housing and a closing body for closing a passage in the housing in mechanical manner, wherein the closing body is movable between an open position and a closing position;
- an actuator configured to move the closing body from the open position to the closing position in less than 100 ms;

- a reservoir for a flame-extinguishing substance;
- an injecting means configured to inject the flame-extinguishing substance into the passage in order to prevent explosion propagation resulting from a non-fully sealed closure by the closing body.

As set forth above, the mechanical closing by the closing body need not be perfect in such an embodiment. By injecting a flame-extinguishing substance in suitable manner a gap or opening resulting from an imperfect closure by the closing body can be quickly and efficiently dealt with or compensated. Note that this gap or opening can for instance be the consequence of an imperfect seal resulting from for instance wear to a rubber ring, but also a consequence of the fact that the closing body has not yet fully reached the closing position, or has sprung back from the closing position.

The location of the injecting means is preferably such that the flame-extinguishing substance makes contact with the closing body at the latest when the closing body reaches the closing position.

According to an advantageous embodiment, the actuator is such that the closing body can reach the closing position from the open position in less than 30 ms. The valve device can also comprise a control for operating the actuator for the purpose of moving the closing body to the closing position and for operating the injecting means for the purpose of injecting the flame-extinguishing substance. The control ensures in advantageous manner that the flame-extinguishing substance is injected in good time and for long enough to prevent explosion propagation in reliable manner. The flame-extinguishing substance will preferably continue to be injected as long as there remains a risk of explosion propagation.

The injecting means is preferably configured to inject the flame-extinguishing substance into the passage within a time period of less than 15 ms, preferably less than 10 ms, following detection of an explosion.

The reservoir is preferably a closed reservoir in which the flame-extinguishing substance is stored under pressure and the injecting means preferably comprises an opening mechanism for opening the reservoir. The distance between the opening mechanism and a point of injection of the flame-extinguishing substance into the passage is preferably less than 20 cm, still more preferably less than 10 cm and most preferably less than 5 cm. The flame-extinguishing substance will in this way be able to reach the passage in the housing very quickly, preferably within 10 ms following detection of the explosion.

The reservoir is preferably mounted on the housing. This will allow the distance between the opening mechanism and a point of injection of the flame-extinguishing substance into the passage to be kept small. The reservoir is preferably a bottle in which $CO_2$ is stored under pressure, still more preferably liquid $CO_2$.

The injecting means preferably comprises an actuator, such as for instance a gas generator, a single-shot actuator (a metron actuator) etc. In addition, the injecting means typically comprises one or more distribution conduits, injection nozzles and the like. It is noted that the actuator of the injecting means can also function as actuator for the purpose of moving the closing body from the open position to the closing position. According to an alternative, two individual actuators are provided.

According to an advantageous embodiment, the injecting means is configured to inject the flame-extinguishing substance such that the injection contributes toward movement of the closing body from the open position to the closing position.

In the case of for instance a butterfly valve the flame-extinguishing substance can be injected in the direction of movement of the closing body from the open to the closing position. In this way the flame-extinguishing substance therefore has a dual function.

The flame-extinguishing substance can for instance be one of the following substances or a combination thereof: an inert gas such as $N_2$ or a noble gas, $CO_2$, extinguishing powder, water, halogen.

The housing can be provided with one or more injection channels through which the flame-extinguishing substance is injectable. At least one injection channel for the flame-extinguishing substance is typically provided on the side of the passage intended for connection to a space in which explosion hazard is present. It is however also possible to provide one or more injection channels on both sides of the closing body. According to a possible embodiment, the closing body itself can also be provided with injection channels through which the flame-extinguishing substance is injectable. The distance between an injection channel and the closing body in the closing position is preferably less than five times the largest dimension of the passage as seen in cross-section, i.e. in the case of a round passage less than five times the diameter of the passage.

It is noted that an explosion may in some cases come from both sides of the passage. A device according to the invention can be used for a situation in which the explosion hazard comes from one side as well as for the situation where the explosion comes from two sides.

The housing and the closing body can for instance be provided in the form of one of the following valve devices: butterfly valve, ball valve, valve with inflatable closing body (such as a quench valve), a guillotine valve, a hinge valve (flap valve), a non-return valve (for instance with a flap valve or a ball). In the case of a butterfly valve (or throttle valve) the closing body is formed by a disc rotating on its axis. The butterfly valve thus moves from open to closed, or vice versa, by rotating through a determined angle. The operation can for instance take place manually or automatically, for instance electrically or pneumatically. Butterfly valves are mainly advantageous in larger conduits. In the case of a spherical valve or ball valve the closing body is formed by a full bore ball which rotates about its axis.

In the case of valves with a closing body having a fixed form a gap will in many cases be present between the closing body and the housing in the closing position, and the injecting means can be configured to inject the flame-extinguishing substance for the purpose of preventing explosion propagation resulting from a non-fully sealed closure by the closing body.

According to a variant, the closing body is an inflatable or otherwise fillable body which is inflated in order to close the passage. Here too openings will typically still be present in the closing position and the flame-extinguishing substance prevents in efficient manner the explosion propagation resulting from a non-fully sealed closure by the closing body.

According to a possible embodiment, the valve device further comprises braking means for braking the movement when the closing body approaches the closing position. According to an alternative, the closing body can be configured to deform plastically when it reaches the closing position, as is described in more detail in the Belgian patent application BE 2012/0742 in the name of applicant, which is included here by way of reference.

According to a possible embodiment, the valve device further comprises detection means for detecting an explosion, which detection means are connected to a control for controlling the movement of the closing body from the open position to the closing position and for controlling the injection of the flame-extinguishing substance.

Embodiments of the invention further relate to a method for preventing explosion propagation in a passage, comprising of closing the passage in mechanical manner by moving a closing body from an open position to a closing position in less than 100 ms, preferably in less than 30 ms, and injecting a flame-extinguishing substance into the passage for the purpose of preventing explosion propagation resulting from a non-fully sealed closure by the closing body.

The method preferably further comprises the step of detecting an explosion, and the flame-extinguishing substance is injected into the passage within a time period of less than 15 ms following detection of the explosion.

The invention also relates to the use of a valve device according to any of the above described embodiments for preventing explosion propagation.

Finally, the invention relates to a system comprising a valve device according to any of the above described embodiments and a container, typically a silo, in which explosion hazard is present, wherein the valve device is provided in a conduit which communicates with the container. The distance between the valve device and the container preferably lies between 0.5 m and 12 m.

In addition, the method is preferably applied using an embodiment of a valve device as described above.

BRIEF DESCRIPTION OF THE DRAWINGS

The invention will be further elucidated on the basis of a number of by no means limitative exemplary embodiments of the device and method according to the invention with reference to the accompanying drawings, in which.

DETAILED DESCRIPTION OF THE INVENTION

Figure 1A:
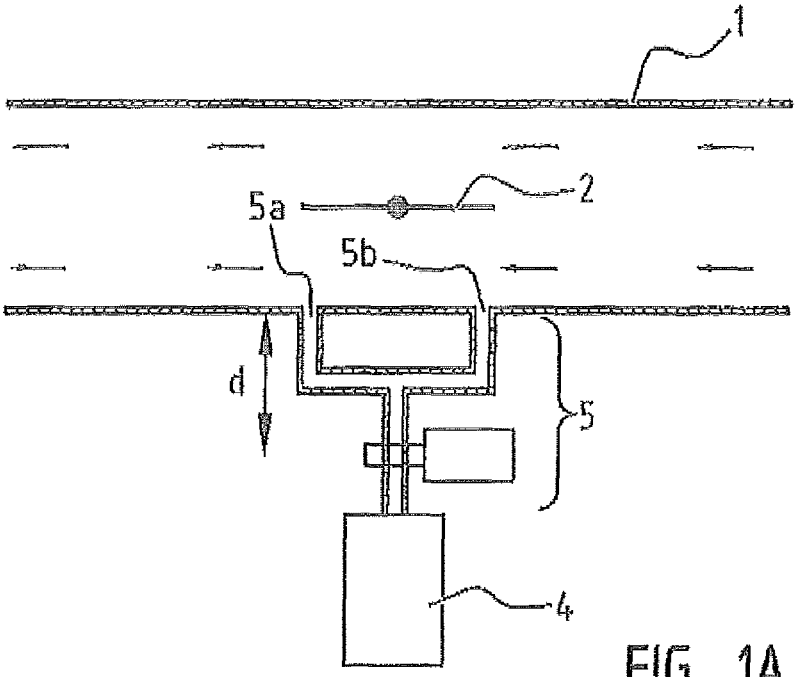
FIGS. 1A and 1B show schematic cross-sections of a first embodiment of a valve device according to the invention in respectively the closing position and the open position.
Figure 1B:
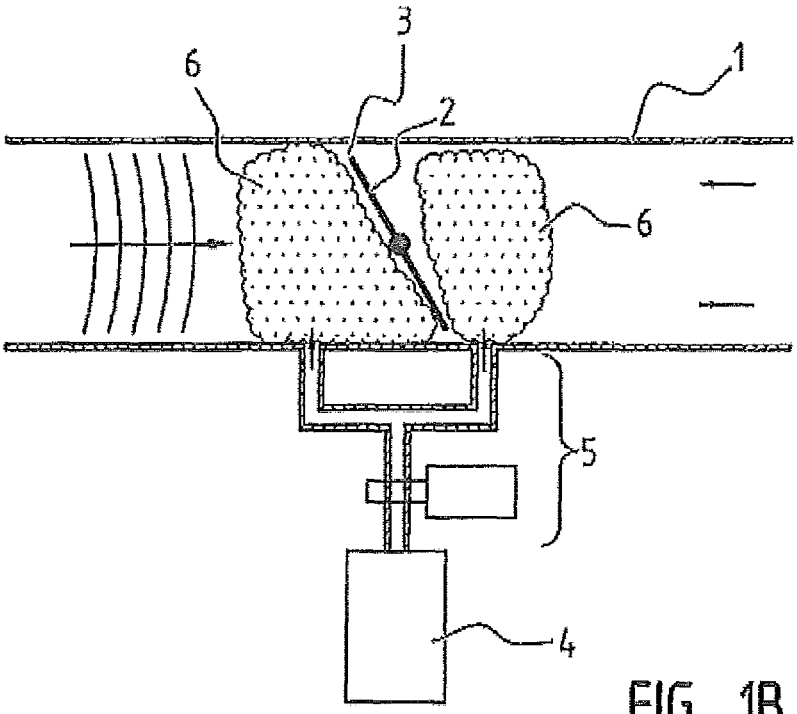

The valve illustrated in FIGS. 1A and 1B can for instance be a butterfly valve. The valve device comprises a housing 1 and a closing body 2 for closing a passage in housing 1 in mechanical manner. The closing body is movable between an open position (FIG. 1A) and a closing position (FIG. 1B). In the closing position, or close to the closing position, a gap 3 is present between housing 1 and closing body 2. The valve device further comprises a reservoir 4 for a flame-extinguishing substance, for instance a bottle of liquid $CO_2$ under pressure, and an injecting means 5 which is configured to inject the flame-extinguishing substance 6 into the passage for the purpose of preventing explosion propagation through gap 3. Injecting means 5 comprises an opening mechanism for opening a seal of reservoir 4 and two feed pipes leading to injection points 5*a*, 5*b* where the flame-extinguishing substance is injected into the passage in housing 1. The distance d between the opening mechanism and the injection points 5*a*, 5*b* is less than 20 cm, preferably less than 10 cm and still more preferably less than 5 cm. The valve device can further comprise an actuator (not shown) for moving closing body 2 from the open position to the closing position, and vice versa.

Figure 2A:
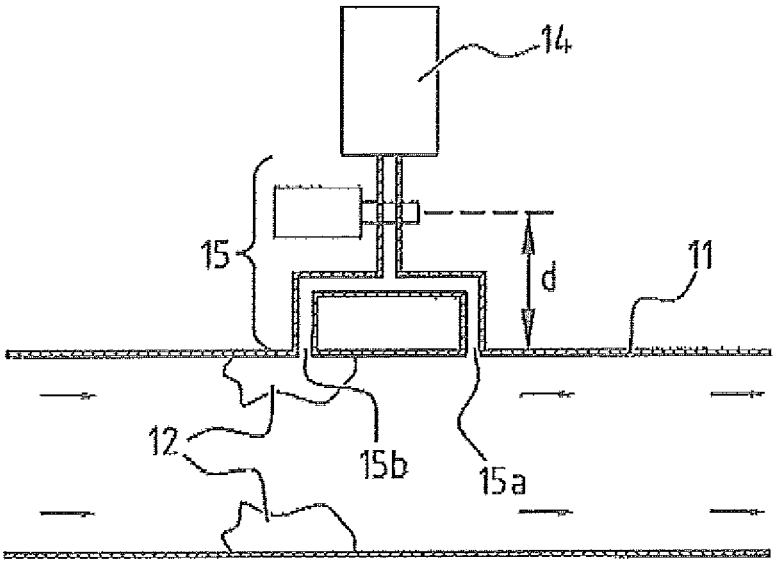
FIGS. 2A and 2B show schematic cross-sections of a second embodiment of a valve device according to the invention in respectively the closing position and the open position.
Figure 2B:
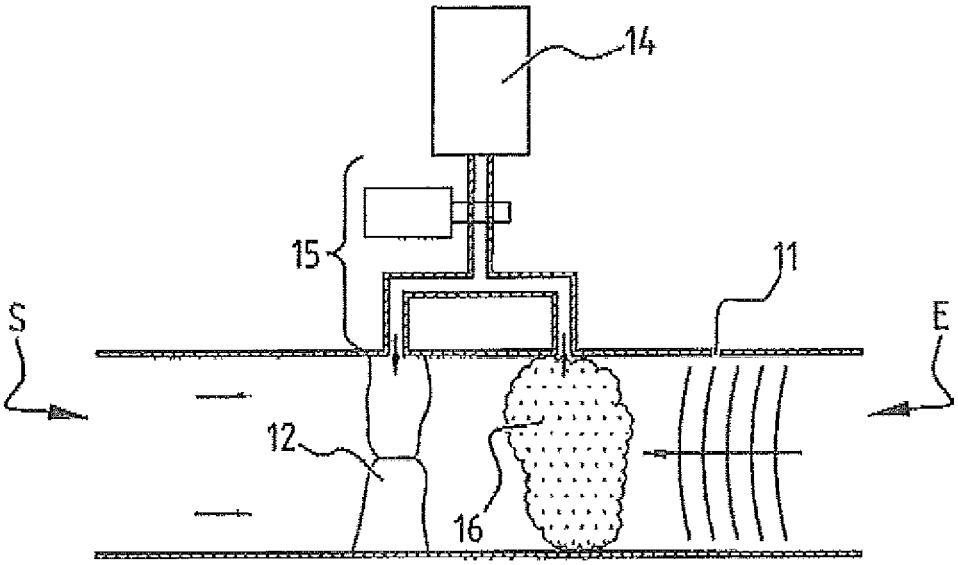

FIGS. 2A and 2B illustrate another variant according to the invention in which the closing body is an inflatable closing body 12 arranged in a housing 11 with a passage. The valve device further comprises a reservoir 14 for a flame-extinguishing substance which is also used in the illustrated embodiment to fill the closing body 12. According to a non-illustrated variant, two reservoirs are provided: a first reservoir with a substance for inflating the closing body and a second reservoir with a flame-extinguishing substance. An injecting means 15 is further provided for injecting the flame-extinguishing substance 16, on the one hand into closing body 12 and on the other into the passage in housing 11 on a side of the passage intended for connection to a space in which explosion hazard is present. Injecting means 15 comprises an opening mechanism for opening a seal of reservoir 14 and two feed pipes leading to an injection point 15*a*, where the flame-extinguishing substance is injected into the passage in housing 11, and an injection point 15*b* for inflating the closing body. Injection point 15*a* is located on the side where an explosion E can occur. The other side of closing body 12 is therefore a protected zone S. The distance d between the opening mechanism and injection point 15*a* is less than 20 cm, preferably less than 10 cm and still more preferably less than 5 cm.

Figure 3A:
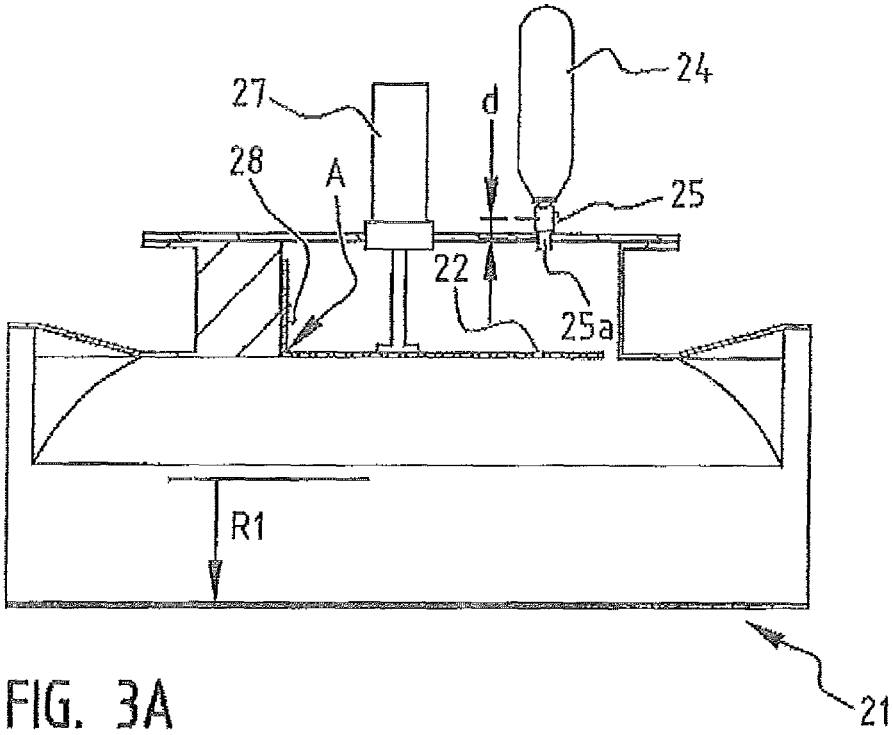
FIGS. 3A, 3B and 3C show schematic cross-sections of a third embodiment of a valve device according to the invention, in the form of a non-return valve, in respectively the open position, closing position, and the closing body of the valve device.
Figure 3B:
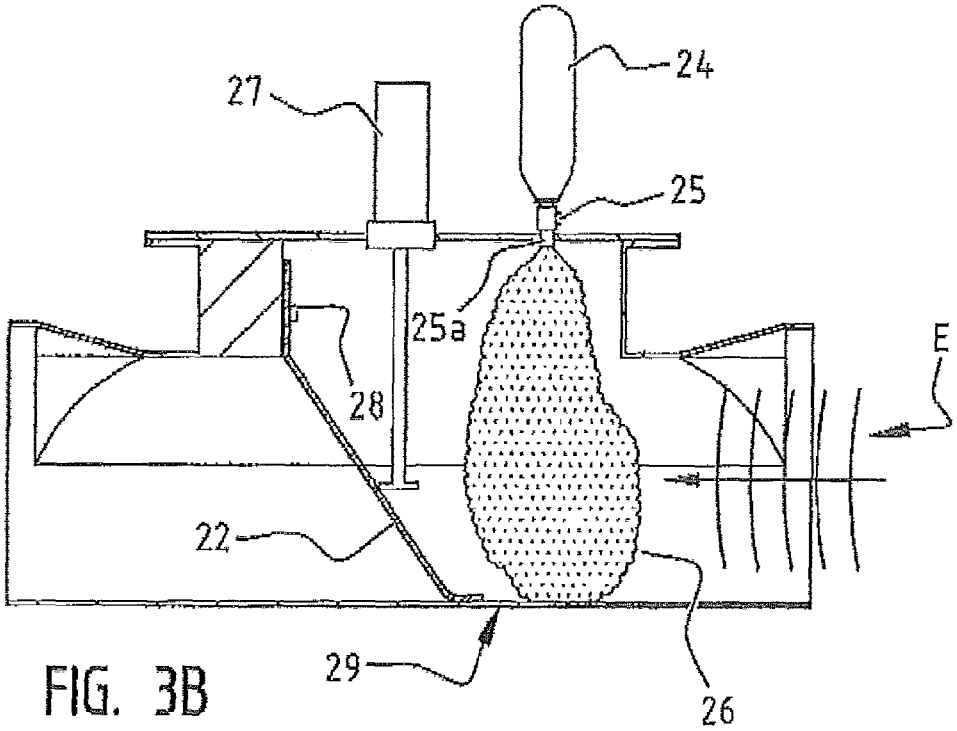
Figure 3C:
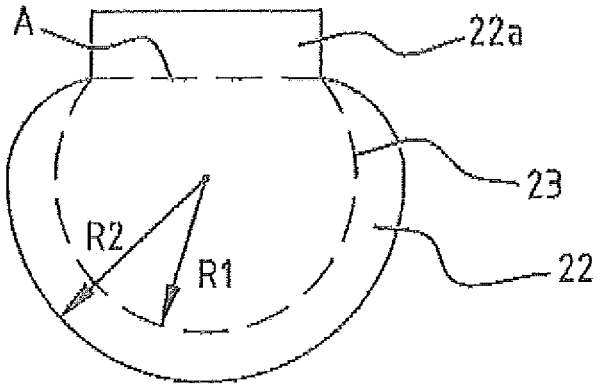

FIGS. 3A, 3B and 3C illustrate a third embodiment of a valve device according to the invention in the form of a non-return valve. The valve device comprises a housing 21 in which a passage extends. Mounted in housing 21 via bolts 28 is a closing body 22 for closing the passage. Closing body 22 is movable between an open position (FIG. 3A) and a closing position (FIG. 3B). Provided for this purpose is an actuator which here takes the form of a piston-cylinder assembly 27. Closing body 22 can be bent along an axis A and is provided with a fixing part 22*a* for fixing closing body 22 in housing 21 via one or more bolts 28. In the illustrated embodiment the passage has a substantially round form with a dimension R1 which is smaller than the corresponding dimension R2 of closing body 22. Designing the closing body 22 in such a manner ensures that the closing body deforms plastically during the movement of closing body 22 from the open position to the closing position. A peripheral part 29 can optionally take a weakened form, for instance by giving this part a wholly or partially thinner form, or by providing recesses therein. In the illustrated embodiment the peripheral part 29 of closing body 22 will be bent. Owing to this plastic deformation a part of the energy of closing body 22 is absorbed, in particular the kinetic energy, whereby the closing body is braked. The skilled person will appreciate that closing body 22 can also be mounted hingedly in the housing, wherein fixing part 22*a* is then omitted. The skilled person will further appreciate that the passage can have any random form, wherein the design of the closing body is adapted to the design of the passage.

It is possible that the plastic deformation results in openings between closing body 22 and housing 21, whereby explosion propagation is still possible. Such an explosion propagation can be further limited or eliminated by providing a chemical barrier in addition to the mechanical barrier. In the illustrated embodiment the valve device comprises a reservoir 24 for storing a flame-extinguishing substance under pressure, typically $CO_2$, and an opening mechanism 25 in the form of a valve to allow the flame-extinguishing substance through into the passage of housing 21. The flame-extinguishing substance is preferably injected in good time and for long enough to prevent or limit explosion propagation in reliable manner. In order to enable a rapid injection the distance d between opening mechanism 25 and injection point 25*a* into the passage is preferably as small as possible. The distance d is preferably less than 10 cm, still more preferably less than 5 cm. The reservoir is preferably mounted for this purpose directly on housing 21. The injected flame-extinguishing substance 26 extends over the whole passage and thus prevents the possibility of an explosion E being propagated through possible gaps present between closing body 22 and the wall of the passage, see FIG. 3B.

The invention is not limited to the above described exemplary embodiments and the skilled person will appreciate that many modifications and variants can be envisaged within the scope of the invention, which is defined solely by the following claims.

The invention claimed is:

1. A valve device for preventing explosion propagation, comprising:

a housing and a closing body for closing a passage in the housing in mechanical manner, wherein the closing body is movable between an open position and a closing position;

an actuator configured to move the closing body from the open position to the closing position in less than 100 ms;

a reservoir for a flame-extinguishing substance; and an injecting means configured to inject the flame-extinguishing substance into the passage in order to prevent explosion propagation resulting from a non-fully sealed closure by the closing body, wherein the reservoir is a closed reservoir in which the flame-extinguishing substance is stored under pressure, wherein the injecting means comprises an opening mechanism for opening the reservoir, and wherein the distance between the opening mechanism and a point of injection of the flame-extinguishing substance into the passage is less than 20 cm.

2. The valve device as claimed in claim 1, wherein the actuator is configured to move the closing body from the open position to the closing position in less than 30 ms.

3. The valve device as claimed in claim 1, further comprising a control for operating the actuator for the purpose of moving the closing body to the closing position and for operating the injecting means for the purpose of injecting the flame-extinguishing substance.

4. The valve device as claimed in claim 1, wherein the injecting means is configured to inject the flame-extinguishing substance into the passage within a time period of less than 15 ms following detection of an explosion.

5. The valve device as claimed in claim 1, wherein the distance between the opening mechanism and the point of injection of the flame-extinguishing substance into the passage is less than 10 cm.

6. The valve device as claimed in claim 1, wherein the reservoir is mounted on the housing.

7. The valve device as claimed in claim 1, wherein the injecting means is configured to inject the flame-extinguishing substance such that the injection contributes toward movement of the closing body from the open position to the closing position.

8. The valve device as claimed in claim 1, wherein the flame-extinguishing substance is one of the following substances or a combination thereof: $CO_2$, extinguishing powder, water.

9. The valve device as claimed in claim 1, wherein the housing is provided with one or more injection channels through which the flame-extinguishing substance is injectable.

10. The valve device as claimed in claim 1, wherein at least one injection channel for the flame-extinguishing substance is provided on the side of the passage intended for connection to a space in which explosion hazard is present.

11. The valve device as claimed in claim 1, wherein a gap is present between the closing body and the housing in the closing position, and wherein the injecting means is configured to inject the flame-extinguishing substance for the purpose of preventing explosion propagation through the gap.

12. The valve device as claimed in claim 1, wherein detection means are provided for detecting an explosion, which detection means are connected to the control.

13. A method for preventing explosion propagation in a passage, comprising the steps of closing the passage in a mechanical manner by moving a closing body from an open position to a closing position in less than 100 ms, and injecting a flame-extinguishing substance from a reservoir into the passage for the purpose of preventing explosion propagation resulting from a non-fully sealed closure by the closing body, wherein the injecting is performed using an opening mechanism for opening the reservoir, and wherein the distance between the opening mechanism and a point of injection of the flame-extinguishing substance in the passage is less than 20 cm.

14. The method as claimed in claim 13, wherein the closing body is moved from the open position to the closing position in less than 30 ms.

15. The method as claimed in claim 13, further comprising the step of detecting an explosion, wherein the flame-extinguishing substance is injected into the passage within a time period of less than 15 ms following detection of the explosion.

16. The method as claimed in claim 13, wherein the flame-extinguishing substance is injected such that the injection contributes toward movement of the closing body from the open position to the closing position.

17. The method as claimed in claim 13, wherein the flame-extinguishing substance is injected on the side of the passage connected to a space in which explosion hazard is present.

18. The method as claimed in claim 13, wherein a gap is present between the closing body and the housing in the closing position, and that the flame-extinguishing substance is injected for the purpose of preventing explosion propagation through the gap.

19. A system comprising a valve device and a container, in which explosion hazard is present, wherein the valve device is provided in a conduit which communicates with the container; said valve device comprising:

a housing and a closing body for closing a passage in the housing in mechanical manner, wherein the closing body is movable between an open position and a closing position;

an actuator configured to move the closing body from the open position to the closing position in less than 100 ms;

a reservoir for a flame-extinguishing substance; and an injecting means configured to inject the flame-extinguishing substance into the passage in order to prevent explosion propagation resulting from a non-fully sealed closure by the closing body; wherein the reservoir is a closed reservoir in which the flame-extinguishing substance is stored under pressure, wherein the injecting means comprises an opening mechanism for opening the reservoir and wherein the distance between the opening mechanism and a point of injection of the flame-extinguishing substance into the passage is less than 20 cm.

20. The system as claimed in claim 19, wherein the distance between the valve device and the container lies between 0.5 m and 12 m.

* * * * *